US009174109B2

(12) United States Patent
Peterman et al.

(10) Patent No.: US 9,174,109 B2
(45) Date of Patent: Nov. 3, 2015

(54) GOLF CLUB, TRAINING DEVICE AND METHOD FOR ALIGNING HANDS WITH CLUB FACE OF GOLF CLUB

(71) Applicants: Anthony E. Peterman, Austin, TX (US); Brian W. Peterman, Austin, TX (US)

(72) Inventors: Anthony E. Peterman, Austin, TX (US); Brian W. Peterman, Austin, TX (US)

( * ) Notice: Subject to any disclaimer, the term of this patent is extended or adjusted under 35 U.S.C. 154(b) by 0 days.

(21) Appl. No.: 14/609,561

(22) Filed: Jan. 30, 2015

(65) Prior Publication Data

US 2015/0217176 A1 Aug. 6, 2015

Related U.S. Application Data

(60) Provisional application No. 61/934,104, filed on Jan. 31, 2014.

(51) Int. Cl.
*A63B 69/36* (2006.01)

(52) U.S. Cl.
CPC ..... *A63B 69/36* (2013.01)

(58) Field of Classification Search
USPC ..... 473/206, 219, 238, 240, 242, 244, 409
See application file for complete search history.

(56) References Cited

U.S. PATENT DOCUMENTS

| | | | | |
|---|---|---|---|---|
| 2,898,109 | A * | 8/1959 | Williams | 473/240 |
| 3,198,525 | A * | 8/1965 | Smith | 473/238 |
| 4,174,838 | A * | 11/1979 | Paschetto | 473/238 |
| 2002/0123385 | A1* | 9/2002 | Primiano et al. | 473/220 |
| 2009/0143158 | A1* | 6/2009 | Fidge | 473/238 |

* cited by examiner

*Primary Examiner* — Nini Legesse
(74) *Attorney, Agent, or Firm* — Egan, Peterman & Enders LLP.

(57) ABSTRACT

Golf training devices and related method are disclosed that provide to align a golfer's hands with a club face of a golf club. The training device includes a first attachment portion configured to couple the training device to a golf club and a second attachment portion coupled to the first attachment portion. The training device also includes an alignment component coupled to the second attachment portion. The alignment component can be shaped to represent a hitting surface of a different piece of sports equipment. When coupled to a golf club, the training device can be oriented such that the hitting surface of the alignment component is aligned with a club face of the golf club.

20 Claims, 5 Drawing Sheets

GOLF CLUB, TRAINING DEVICE AND METHOD FOR ALIGNING HANDS WITH CLUB FACE OF GOLF CLUB

RELATED APPLICATIONS

This application claims priority to the following provisional application: U.S. Provisional Patent Application Ser. No. 61/934,104, filed Jan. 31, 2014, and entitled "GOLF CLUB, TRAINING DEVICE AND METHOD FOR ALIGNING HANDS WITH CLUB FACE OF GOLF CLUB," which is hereby incorporated by reference in its entirety.

TECHNICAL FIELD

The present invention relates to the field of sports training and more particularly to the field of golf training devices and methods.

BACKGROUND

Golf is a sport widely played and enjoyed. Although popular and fun for both professionals and amateurs, golf can be a difficult sport to learn and to develop and maintain skills, especially when taken up during adulthood. For many people, swinging a golf club and hitting a golf ball solidly and in a desired direction is hard and discouraging even after spending time and effort practicing. For this reason, there has developed a wide ranging and broad diversity of golf training devices and methods to help pros and amateurs learn to play golf and to play with skill.

One example of an existing golf training device is the SKYPRO device available from SKYGOLF. This device attaches to the shaft of a golf club and uses sensors embedded in the device to track variables of the golf swing including swing plane and speed. This device indicated generally at 10 in FIG. 1 has an attachment mechanism 12 to secure the device to the shaft of a golf club. The device 10 has a housing 14 containing active components such as power, sensing, processing and communication. FIG. 2 shows how the device 10 can be attached to the shaft 16 of a golf club below the lower end of a grip 18. By attaching device 10 to the shaft 16, the device 10 is carried along with the shaft as a golfer swings the golf club. This enables the device 10 to sense and record data relevant to the golfer's swing.

However, even with detailed and complex golf training devices such as the SKYPRO device, the sport of golf remains a difficult and discouraging sport for many people. Devices like SKYPRO and other existing devices and methods still require significant time practicing and training for people to learn and develop skill to repeat the golf swing and successfully hit the golf ball. In part due to this difficulty and time required for practice, golf is presently in a decline with regard to participation and there are a number of efforts underway by the United States Golf Association, Golf Digest magazine, professional golf tours and others to try to grow interest and participation in the game and grow the game of golf. There is a clear need to find ways to encourage people to start playing golf and for them to have success and enjoy it enough to keep playing.

SUMMARY

According to the present invention, a golf training device is provided to align a golfer's hands with a club face of a golf club. The training device includes a first attachment portion that is configured to couple the training device to a golf club and a second attachment portion coupled to the first attachment portion. The training device includes an alignment component coupled to the second attachment portion. The alignment component can be shaped to represent a hitting surface of a different piece of sports equipment. When coupled to a golf club, the training device can be oriented such that the hitting surface of the alignment component is aligned with a club face of the golf club.

Also according to the present invention, a method is provided for golf training by aligning a golfer's hands with a club face of a golf club. The method includes coupling an alignment component to a golf club where the alignment component is shaped to represent a hitting surface of a different piece of sports equipment. The method also includes orienting the hitting surface of the alignment component with a club face of the golf club.

One technical advantage of the present invention is that it allows a person skilled in a different sport and skilled at hitting an object with a different piece of sports equipment to cross-over and use that skill for golf. The present invention provides an alignment component representing the other piece of sports equipment that can be oriented and aligned to the club face of the golf club, and the golfer can use his or her skill with the other sport to align the golfer's hands with the golf club face. By doing so, the golfer's skill in hitting an object in the other sport can be harnessed to allow the golfer to hit a golf ball solidly and in the intended direction.

Other features and variations could also be implemented, as desired, and related systems and methods can be utilized, as well.

DESCRIPTION OF THE DRAWINGS

It is noted that the appended drawings illustrate only example embodiments of the invention and are, therefore, not to be considered limiting of its scope, for the invention may admit to other equally effective embodiments.

DETAILED DESCRIPTION

Figure 1:
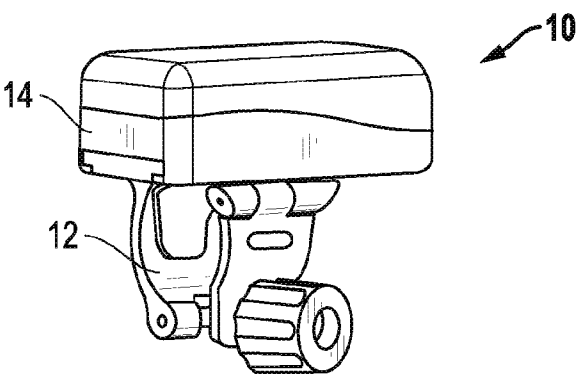
FIG. 1 (Prior Art)
FIG. 1 is a perspective view of one example of an existing golf training device.
Figure 2:
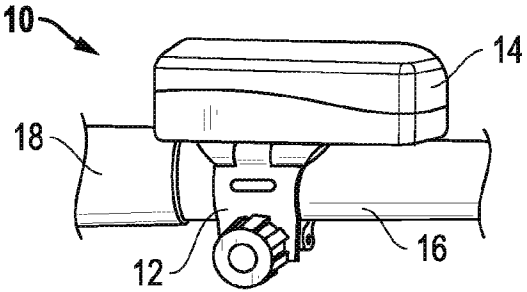
FIG. 2 (Prior Art)
FIG. 2 is a side view of one example of an existing golf training device connected to the shaft of a golf club.

There is need for a golf training device and method that makes the sport of golf more easily played and especially for people who are not able to commit significant time practicing golf over a sustained and long period. More people would be interested in and play golf if the sport were more accessible to casual play without needing practice time between rounds of golf. People generally have more time for sports and develop higher skill levels as children and youth in recreational, club and school sports. There is wide spread youth participation in various sports, and those skills learned earlier in life generally stay with people for a lifetime. Many of those sports involve hitting an object using a piece of sports equipment and consequently many people have skills to play such sports. However, many of those people struggle when attempting to play golf and are unable to translate their skills in other sports to the hitting of a golf ball. Existing golf training devices and methods, including those such as that shown in FIGS. 1 and 2, do not provide a way to use such existing skills in other sports.

A need exists for golf training that allows a golfer to translate or cross over skills from a different sport and that is provided according to the teachings of the present invention.

Figure 3A:
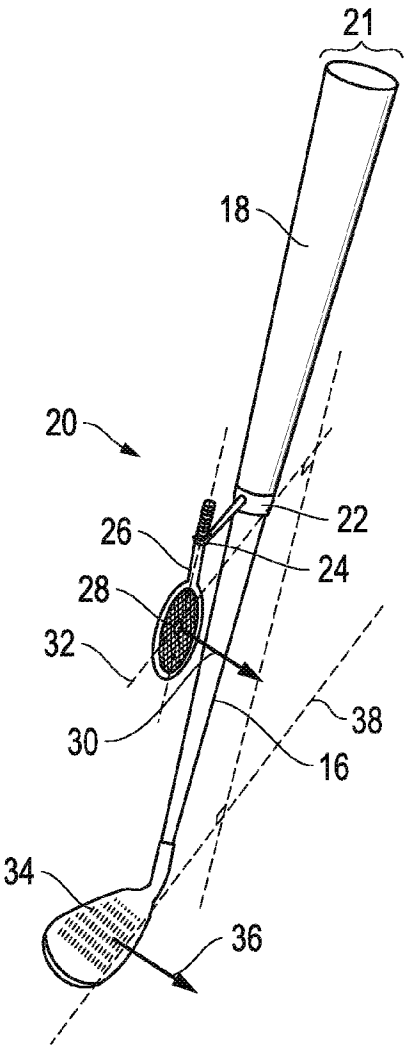
FIGS. 3A-B are perspective views of embodiments of a golf club training device according to the present invention connected to the shaft of a golf club.

FIG. 3A is a perspective view of one embodiment of the present invention showing a golf training device indicated generally at 20. The training device 20 is coupled to a golf club 21 having a shaft 16 and a grip 18. The training device 20 has a first attachment portion 22 configured to couple the training device 10 to the shaft 16. In the illustrated embodiment, training device 20 is attached proximate the lower end of the grip 18. Training device 20 has a second attachment portion 24 that is coupled to the first attachment portion 22. An alignment component 26 is coupled to the second attachment portion 24, and the alignment component 26 is shaped to represent a hitting surface 28 of a different piece of sports equipment. In the illustrated embodiment depicted in FIG. 3A, the alignment component 26 represents a tennis racket. As shown, the hitting surface 28 of the alignment component 26 faces a hitting direction 30 in which an object would travel if hit by the hitting surface 28. Alignment line 32 is perpendicular to hitting direction 30 and represents the alignment orientation of the hitting surface 28 that would be known by a tennis player in this embodiment. As shown, the golf club 21 has a club face 34 with a hitting direction 36 and an alignment orientation represented by alignment line 38. According to the present invention, the training device 20 can be oriented when coupled to the golf club 21 such that the hitting surface 28 of the alignment component 26 is aligned with the club face 34 of the golf club 21. In that orientation as shown, the alignment line 32 and the alignment line 38 are aligned with one another, and the hitting direction 30 and hitting direction 36 are aligned with one another.

It is noted that one or more additional attachment portions could be used to couple the training device 20 to the golf club 21 and that one or more additional attachment portions could also be used to couple to the alignment component 26. Further, the training device 20 can be formed as a single integral device or can be formed as multiple different pieces that are coupled together to form the training device 20. Other variations could also be implemented while still utilizing a training device that represents the hitting surface of a piece of sports equipment that is not a piece of golf equipment.

It is an advantage of the present invention to allow a golfer to cross over to golf and use the golfer's skill in a different sport to naturally and comfortably align his or her hands with the club face 34 of a golf club 21. Having done that, the golfer skilled in hitting an object with a different piece of sport equipment can successfully hit a golf ball by using swing thoughts and skills from the other sport. The person knows from practice and playing the other sport how his or her hands are oriented with the hitting surface 28 of that other piece of equipment represented by alignment component 26. The person knows how to hit with the hitting surface 28 of the other equipment to make the object such as a tennis ball go in an intended direction. A person skilled in the game of tennis, for example, would know the orientation between his or her hands and the face of the tennis racket and how to hit a tennis ball to various parts of the tennis court. Despite that skill, the tennis player may have significant difficulty hitting a golf ball solidly or in the intended direction. According to the teachings of the present invention, a path is provided to harness that tennis skill and allow the golfer to cross over and use that skill for golf. It should be understood that the alignment component 26 could represent any of a number of different pieces of sports equipment used to hit an object in a sport other than golf, including but not limited to baseball, softball, hockey, lacrosse, field hockey, ping pong, racket ball, squash, cricket, and croquet.

Figure 3B:
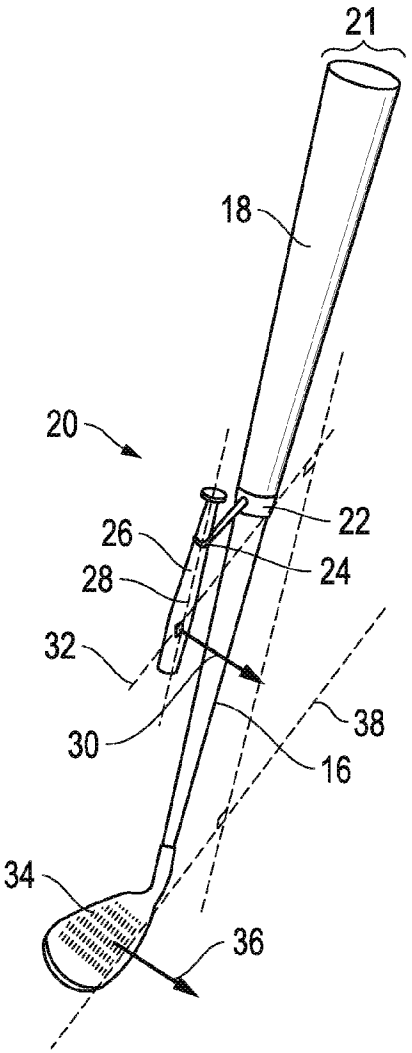

FIG. 3B is a perspective view of another embodiment of the present invention showing a golf training device indicated generally at 20. The training device 20 is coupled to a golf club 21 having a shaft 16 and a grip 18. The training device 20 has a first attachment portion 22 configured to couple the training device 10 to the shaft 16. In the illustrated embodiment, training device 20 is attached proximate the lower end of the grip 18. Training device 20 has a second attachment portion 24 that is coupled to the first attachment portion 22. An alignment component 26 is coupled to the second attachment portion 24, and the alignment component 26 is shaped to represent a hitting surface 28 of a different piece of sports equipment. In the illustrated embodiment depicted in FIG. 3B, the alignment component 26 represents a baseball or softball bat. As shown, a hitting surface 28 of the alignment component 26 faces a hitting direction 30 in which an object would travel if hit by the hitting surface 28. Alignment line 32 is perpendicular to hitting direction 30 and represents the alignment orientation of the hitting surface 28 that would be known by a baseball or softball player in this embodiment. As shown, the golf club 21 has a club face 34 with a hitting direction 36 and an alignment orientation represented by alignment line 38. According to the present invention, the training device 20 can be oriented when coupled to the golf club 21 such that the hitting surface 28 of the alignment component 26 is aligned with the club face 34 of the golf club 21. In that orientation as shown, the alignment line 32 and the alignment line 38 are aligned with one another, and the hitting direction 30 and hitting direction 36 are aligned with one another.

As indicated above, it is an advantage of the present invention to allow a golfer to cross over to golf and use the golfer's skill in a different sport to naturally and comfortably align his or her hands with the club face 34 of a golf club 21. A person skilled in the game of baseball or softball, for example, would know the orientation between his or her hands and the barrel of the bat and how to hit a baseball or softball to various parts of the baseball or softball field. Despite that skill, the baseball or softball player may have significant difficulty hitting a golf ball solidly or in the intended direction. According to the teachings of the present invention, a path is provided to harness that baseball or softball skill and allow the person to cross over and use that skill for golf. It should again be understood that the alignment component 26 could represent any of a number of different pieces of sports equipment. In short, the alignment component 26 can be any non-golf sports equipment for which a person has developed eye-hand coordination and related skill in hitting another object such that this previously developed skill can be harnessed and applied to allow the person to cross that previously developed skill over to hitting a golf ball.

Figure 4:
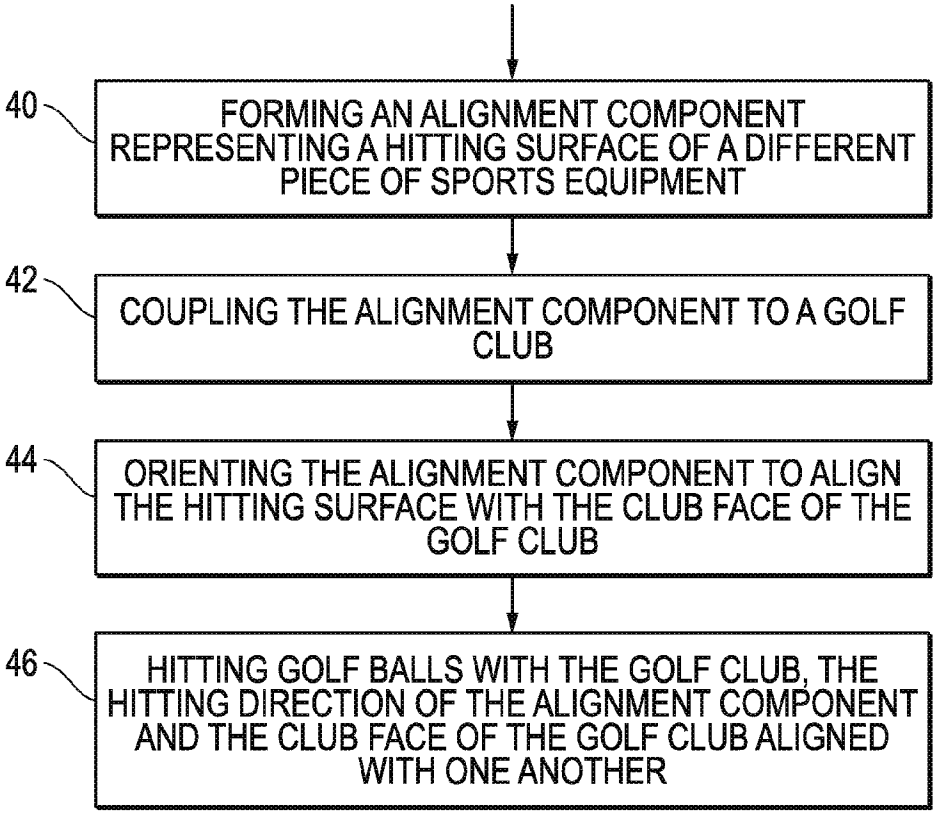
FIG. 4 is a flow chart of one embodiment of a method for golf training according to the present invention.

FIG. 4 is a flow chart of one embodiment of a method for golf training according to the present invention. As shown in step 40, an alignment component is formed representing a hitting surface of a piece of sports equipment different from golf. In step 42, the alignment component is coupled to a golf club. In one embodiment, as shown in FIGS. 3A-B, the alignment component can be coupled to the shaft of a golf club proximate the lower end of the grip. In step 44 of FIG. 4, the alignment component is oriented such that the hitting surface is aligned with the club face of the golf club. Then, in step 46, the golf club and alignment component can be used to hit golf balls while the hitting direction of the alignment component and the club face are aligned. For example, in the tennis embodiment shown in FIG. 3A, the golfer would be able to see the orientation of his or her hands on the grip of the golf club in relation to the hitting surface of the tennis racket. This would also align the golfer's hands with the club face of the golf club because the alignment component and club face have been aligned in step 44. Consequently, the golfer who is skilled at tennis can hit golf balls solidly and in the correct direction by referencing the tennis racket alignment component. The golfer who is a skilled tennis player would know how to adjust if he or she were hitting tennis balls off target, and by reference to the alignment component the golfer can make the same adjustment to compensate for any off target golf shots according to the advantages of the present invention. Similarly, in the bat embodiment shown in FIG. 3B, the golfer would be able to see the orientation of his or her hands on the grip of the golf club in relation to the hitting surface of the bat. It is again noted, as stated above, that the alignment component 26 can be configured to represent any of a number of different pieces of sports equipment.

Figure 5A:
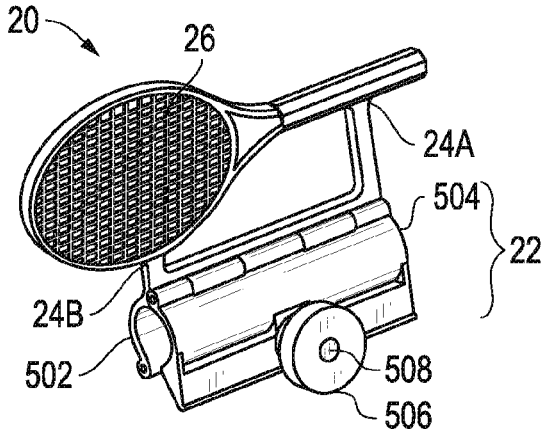
FIGS. 5A-D are further perspective and plan views for a racket embodiment of a golf club training device according to the present invention.
Figure 5B:
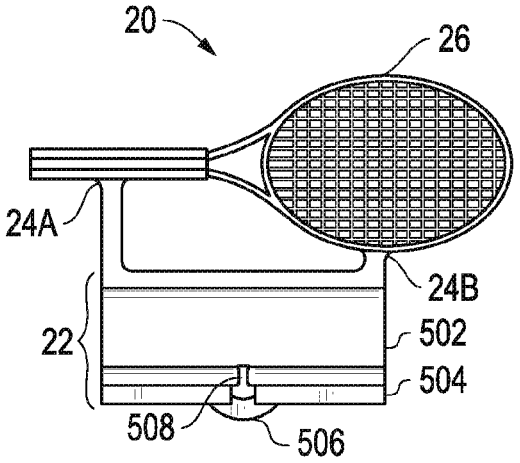
Figure 5C:
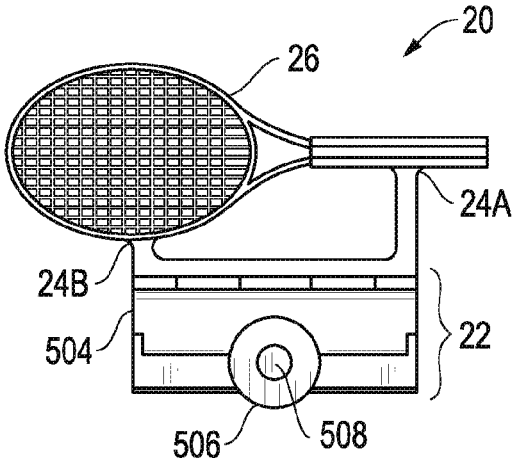
Figure 5D:
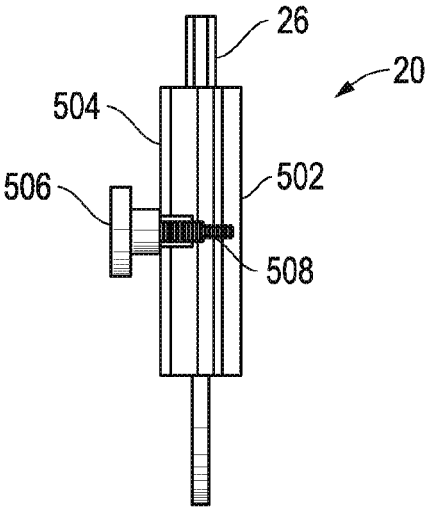

FIGS. 5A-D are further perspective and plan views for a racket embodiment of a golf club training device 20 according to the present invention. FIG. 5A is a perspective view having a racket as the alignment component 26, two second attachment portions 24A and 24B, and a first attachment portion 22. For this embodiment, the first attachment portion 22 includes a first component 502 and a second component 504 that engage together to form a hinge. For this racket embodiment, the first component 502 for the first attachment portion 22, the two second attachment portions 24A and 24B, and the alignment component 26 are formed as a single integral piece. A screw 506 engages a threaded rod 508 that extends from the first component 502 through a notch within the second component 504. The threaded rod 508 is rotatably coupled to the first component 502 so that it can be rotated open to allow a shaft to be inserted into the first attachment portion 22 or rotated closed to engage the notch for the second component 504. When first attachment portion 22 is placed around a golf club shaft, the threaded rod 508 is rotated closed into the notch within the second component 504, and the screw 506 is rotated clockwise to urge the second component 504 towards the first component 502. As such, the first and second components 502 and 504 are tightened around the golf club shaft to secure the golf club training device 20 to the golf club shaft. To release the first attachment portion 22, the screw 506 is rotated counter-clockwise to urge the second component 504 away from the first component 502, and the threaded rod 508 is rotated open to allow the golf club training device 20 to be separated from the golf club shaft. FIGS. 5B and 5C are side views for this racket embodiment, and FIG. 5D is a bottom view for this racket embodiment. As shown further with respect to FIGS. 7A-B, a pin can be used to provide a hinge connection between the first and second components 502 and 504 for the first attachment portion 22, and a pin can be used to provide a rotatable connection between the threaded rod 508 and the first component 502.

Figure 6A:
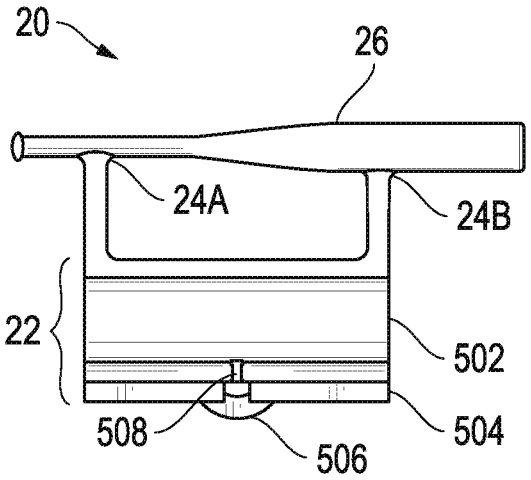
FIGS. 6A-B are further plan views for a bat embodiment of a golf club training device according to the present invention.
Figure 6B:
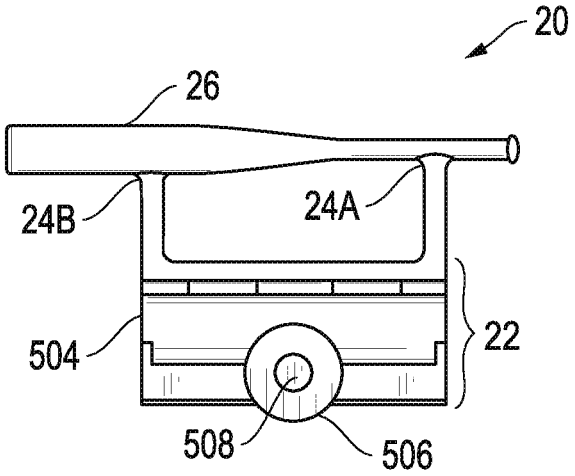

FIGS. 6A-B are further plan views for a bat embodiment of a golf club training device 20 according to the present invention. FIG. 6A is the same as FIG. 5A except that a bat is the alignment component 26 instead of a racket. Similarly, FIG. 6B is the same as FIG. 5B except that a bat is the alignment component 26 instead of a racket. This bat embodiment operates in the same way as described for the racket embodiment above.

Figure 7A:
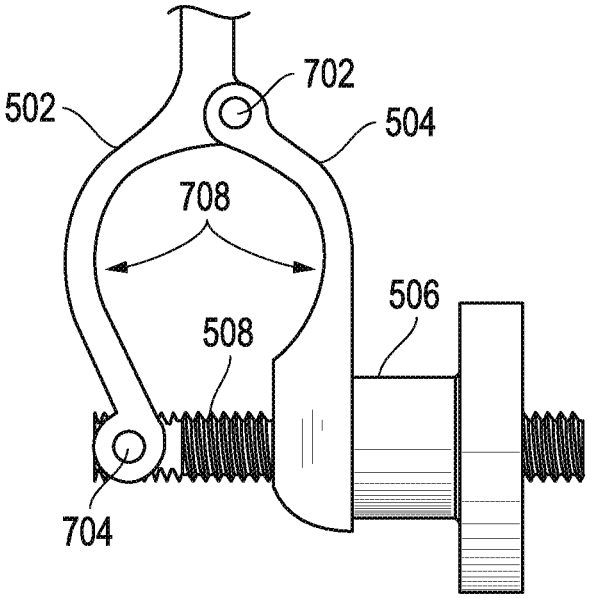
FIGS. 7A-B are side views of example embodiments for components of the attachment portion of the golf club training device.
Figure 7B:
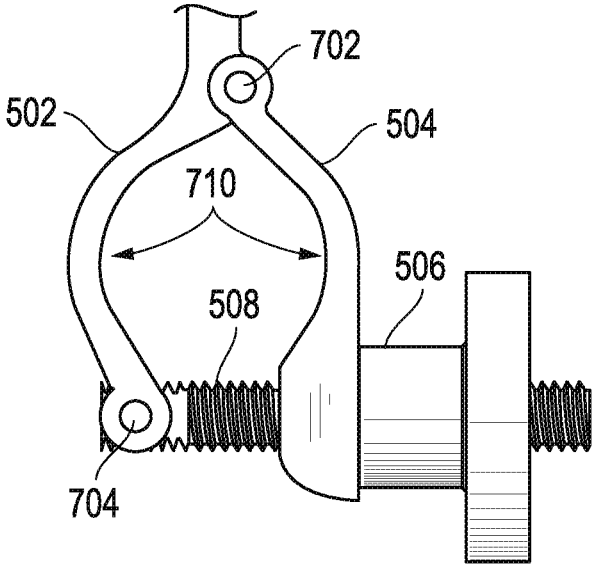

FIGS. 7A-B are side views of example embodiments for the first and second components 502 and 504 for the first attachment portion 22 of the golf club training device 20. A first pin 702 provides a hinge connection between the first and second components 502 and 504. A second pin 704 provides a rotatable connection between the first component 502 and the threaded rod 508. For the embodiment of FIG. 7A, the inside curves 708 that engage the golf club shaft is relatively circular in shape. For the embodiment of FIG. 7B, the inside curvature 710 that engage the golf club shaft is relatively elliptical in shape. It is also noted that one or more pads, such as foam pads, can be placed along the inside curves 708 and 710 to help with engagement of the golf club shaft. It is further noted that additional shapes, curvatures, and/or other variations and components could also be implemented as desired.

Further modifications and alternative embodiments of the disclosed embodiments will be apparent to those skilled in the art in view of this description. It will be recognized, therefore, that the invention is not limited by these example arrangements. Accordingly, this description is to be construed as illustrative only and is for the purpose of teaching those skilled in the art the manner of carrying out the invention. It is to be understood that the forms of the invention herein shown and described are to be taken as example embodiments. Various changes may be made in the implementations and architectures and different embodiments can be implemented. For example, equivalent elements may be substituted for those illustrated and described herein, and features can be utilized independently of other features, all as would be apparent to one skilled in the art after having the benefit of this description of the invention.

What is claimed is:

1. A golf training device to align hands with a club face of a golf club, comprising:

a first attachment portion configured to couple the training device to a golf club;

a second attachment portion coupled to the first attachment portion; and an alignment component coupled to the second attachment portion, the alignment component shaped to represent a hitting surface of a hitting device, the hitting device representing a piece of sports equipment different from a golf club;

wherein the training device can be oriented when coupled to a golf club such that the hitting surface of the alignment component is aligned with a club face of the golf club.

2. The golf training device of claim 1, wherein the hitting device comprises a racket.

3. The golf training device of claim 1, wherein the hitting device comprises a bat.

4. The golf training device of claim 1, wherein the alignment component has a least one curved surface representing a hitting surface.

5. The golf training device of claim 1, wherein the alignment component has at least one flat surface representing a hitting surface.

6. The golf training device of claim 1, comprising one or more additional attachment portions configured to be coupled to the golf club.

7. The golf training device of claim 1, further comprising one or more additional attachment portions configured to be coupled to the alignment component.

8. A golf club and training device to align hands with a club face of a golf club, comprising:

a golf club having a grip, a shaft and a club face; and a golf training device having:

a first attachment portion configured to couple the training device to a golf club;

a second attachment portion coupled to the first attachment portion; and an alignment component coupled to the second attachment portion, the alignment component shaped to represent a hitting surface of a hitting device, the hitting device representing a piece of sports equipment different from a golf club;

wherein the training device is oriented such that the hitting surface of the alignment component is aligned with the club face of the golf club.

9. The golf club and training device of claim 8, wherein the hitting device comprises a racket.

10. The golf club and training device claim 8, wherein the hitting device comprises a bat.

11. The golf club and training device of claim 8, wherein the alignment component has a least one curved surface representing a hitting surface.

12. The golf club and training device of claim 8, wherein the alignment component has at least one flat surface representing a hitting surface.

13. The golf club and training device of claim 8, further comprising one or more additional attachment portions coupled to the golf club.

14. The golf club and training device of claim 8, further comprising one or more additional attachment portions coupled to the alignment component.

15. A method for golf training to align hands with a club face of a golf club, comprising:

coupling an alignment component to a golf club, the alignment component shaped to represent a hitting surface of a hitting device, the hitting device representing a piece of sports equipment different from a golf club; and orienting the alignment component to align the hitting surface with a club face of the golf club.

16. The method of claim 15, wherein the hitting device comprises a racket.

17. The method of claim 15, wherein the hitting device comprises a bat.

18. The method of claim 15, wherein the alignment component has a least one curved surface representing a hitting surface.

19. The method of claim 15, wherein the alignment component has at least one flat surface representing a hitting surface.

20. The method of claim 15, wherein one or more attachment portions are used in the coupling step.

* * * * *